US011155378B2

(12) United States Patent
Savoie-Lavigueur et al.

(10) Patent No.: US 11,155,378 B2
(45) Date of Patent: Oct. 26, 2021

(54) GATING SYSTEM FOR ACCUMULATING ITEMS AND RELATED FILLING MACHINE AND METHODS

(71) Applicant: Blue Sky Ventures (Ontario) Inc., Toronto (CA)

(72) Inventors: Guillaume Savoie-Lavigueur, Coteau-du-lac (CA); Alexandre Lebel, Laval (CA); Simon Lajoie, Montréal (CA); Olivier Caron, Mirabel (CA); Guillaume Chabot-Nobert, Verdun (CA); Steve Boissonneault, Saint-Hippolyte (CA)

(73) Assignee: BLUE SKY VENTURES? (ONTARIO) INC., Toronto (CA)

( * ) Notice: Subject to any disclaimer, the term of this patent is extended or adjusted under 35 U.S.C. 154(b) by 0 days.

(21) Appl. No.: 16/837,242

(22) Filed: Apr. 1, 2020

(65) Prior Publication Data

US 2020/0317382 A1 Oct. 8, 2020

Related U.S. Application Data

(60) Provisional application No. 62/915,867, filed on Oct. 16, 2019, provisional application No. 62/829,836, filed on Apr. 5, 2019.

(51) Int. Cl.
*B65B 57/20* (2006.01)
*B65B 1/30* (2006.01)
(Continued)

(52) U.S. Cl.
CPC ..... *B65B 57/20* (2013.01); *B65B 1/06* (2013.01); *B65B 1/30* (2013.01); *B65B 57/145* (2013.01)

(58) Field of Classification Search
CPC ..... B65B 57/20; B65B 57/145; B65B 1/30; B65B 1/06; B65B 35/54; B65B 35/12
(Continued)

(56) References Cited

U.S. PATENT DOCUMENTS 3,377,771 A 4/1968 Schmidt, Sr.
3,549,008 A 12/1970 Anderson
(Continued)

FOREIGN PATENT DOCUMENTS

CA 2749623 A1 2/2013
CA 2754274 A1 3/2013
(Continued)

OTHER PUBLICATIONS

Canadian Intellectual Property Office, International Search and Written Opinion of the International Searching Authority, International Application No. PCT/IB2020/053104, 8 pages (dated Jul. 16, 2020).

*Primary Examiner* — Jason K Niesz
(74) *Attorney, Agent, or Firm* — Thompson Hine LLP

(57) ABSTRACT

A filling machine for filling a receptacle with a plurality of items includes a first item drop path having an outlet end, a second item drop path having an outlet end, the second item drop path distinct from the first item drop path and a gating system for selectively accumulating and releasing items. The gating system includes: a single gate mechanism configured for selectively and independently controlling both (i) whether items can exit the outlet end of the first item drop path and (ii) whether items can exit the outlet end of the second item drop path.

28 Claims, 16 Drawing Sheets

(51) Int. Cl.
*B65B 1/06* (2006.01)
*B65B 57/14* (2006.01)

(58) Field of Classification Search
USPC ..... 141/243
See application file for complete search history.

(56) References Cited

U.S. PATENT DOCUMENTS 3,631,255 A 12/1971 Gender et al.
3,805,061 A 4/1974 De Missimy et al.
3,880,289 A 4/1975 Gray
3,914,601 A 10/1975 Hoover et al.
4,147,619 A 4/1979 Wassmer et al.
4,157,468 A 6/1979 Primiano
4,205,973 A 6/1980 Ryan
4,207,985 A 6/1980 Lockett et al.
4,266,124 A 5/1981 Weber et al.
4,350,442 A 9/1982 Arild et al.
4,666,045 A 5/1987 Gillespie et al.
4,699,273 A 10/1987 Suggi-Liverani et al.
4,718,558 A 1/1988 Castaneda
4,863,041 A 9/1989 Bailey
4,946,045 A 8/1990 Ditchburn et al.
5,077,477 A 12/1991 Stroman et al.
5,130,532 A 7/1992 Clemens
5,184,732 A 2/1993 Ditchburn et al.
5,353,937 A 10/1994 Childress
5,448,363 A 9/1995 Hager
5,463,839 A 11/1995 Stange et al.
5,562,214 A 10/1996 Castañeda et al.
5,583,334 A 12/1996 Baumann
5,667,096 A 9/1997 Wu
5,669,200 A 9/1997 Disrud
5,703,784 A 12/1997 Pearson
5,784,863 A 7/1998 Davis
5,954,206 A 9/1999 Mallon et al.
6,185,901 B1 2/2001 Aylward
6,250,497 B1 6/2001 Pearson et al.
6,681,550 B1 1/2004 Aylward
6,786,357 B2 9/2004 Renard
6,993,884 B2 2/2006 Baranowski
7,036,679 B2 5/2006 Baranowski
7,063,215 B2 6/2006 Baranowski
7,081,713 B2 7/2006 Jürs et al.
7,128,204 B2 10/2006 Baranowski
7,174,693 B2 2/2007 Wooldridge
7,242,017 B2 7/2007 Arnold et al.
7,339,660 B1 3/2008 Cohn et al.
7,480,038 B2 1/2009 Cohn et al.
7,656,520 B2 2/2010 Cohn et al.
7,905,340 B2 3/2011 Monti
7,956,623 B2 6/2011 Bassani et al.
8,006,468 B2 8/2011 Bassani
8,225,925 B2 7/2012 Bassani
8,386,073 B2 2/2013 Kim
8,424,274 B2 4/2013 Aylward et al.
9,085,380 B2 7/2015 Monti
9,199,748 B2 12/2015 Cremer
9,274,510 B2 3/2016 Burger et al.
9,434,487 B2 9/2016 Bassani
2003/0034282 A1 2/2003 Safai
2007/0175911 A1 8/2007 Kumabe et al.
2008/0011764 A1* 1/2008 Geltser ..... B65B 57/20 221/1
2009/0199512 A1 8/2009 Sala
2012/0145741 A1 6/2012 Enomoto
2013/0042943 A1* 2/2013 Bassani ..... B65G 27/04 141/11
2016/0251094 A1 9/2016 Takahama et al.
2016/0251095 A1 9/2016 Takahama et al.
2016/0253474 A1 9/2016 Takahama et al.
2016/0287480 A1 10/2016 Hancock et al.
2018/0244476 A1 8/2018 Fujii
2019/0008165 A1 1/2019 Weiss

FOREIGN PATENT DOCUMENTS

CA 2628634 C 8/2013
EP 1506923 B1 2/2005
EP 2523859 B1 6/2014
WO 2016/020663 2/2016
WO 2018/146475 8/2018

* cited by examiner

GATING SYSTEM FOR ACCUMULATING ITEMS AND RELATED FILLING MACHINE AND METHODS

TECHNICAL FIELD

This application relates generally to gating systems for collecting and releasing items and, more specifically, to a gating system for collecting and releasing specific counts of items, such as falling items, as may be used in filling machines in which items are being checked, counted and grouped for purposes of filling a container or package with a set number of the items.

BACKGROUND

In the packaging of bulk items, such as pharmaceutical tablets or capsules, the items must be counted and grouped in order to fill containers, packages or other receptacles with a desired number of the items. Delivering a specific count of the items to the receptacle is important and a variety of gating systems have been used in the past. Achieving desired item count while at the same time achieving high speed filling is critical, and therefore improvements to filling machines are continuously sought, including improvements to the gating systems utilized in filling machines.

SUMMARY

In one aspect, a filling machine for filling a receptacle with a plurality of items includes a first item drop path having an outlet end, a second item drop path having an outlet end, the second item drop path distinct from the first item drop path and a gating system for selectively accumulating and releasing items. The gating system includes: a single gate mechanism configured for selectively and independently controlling both (i) whether items can exit the outlet end of the first item drop path and (ii) whether items can exit the outlet end of the second item drop path.

In another aspect, a gating system for accumulating and releasing items includes a first item drop path having an outlet end, a second item drop path having an outlet end, the second item drop path distinct from the first item drop path and a first gate mechanism with a single gate wall configured and movable for selectively and independently controlling both (i) whether items can exit the outlet end of the first item drop path and (ii) whether items can exit the outlet end of the second item drop path.

In a further aspect, a gating system for accumulating and releasing items includes a first item path having an outlet end, a second item path having an outlet end, the second item path adjacent to and distinct from the first item path and a single gate mechanism having an arcuate wall member that defines a gap, wherein the arcuate wall member is mounted for rotation. A gate drive is provided for selectively and independently rotating the single gate mechanism to control both (i) whether items can exit the outlet end of the first item path via the gap and (ii) whether items can exit the outlet end of the second item path via the gap.

The details of one or more embodiments are set forth in the accompanying drawings and the description below. Other features, items, and advantages will be apparent from the description and drawings, and from the claims.

DETAILED DESCRIPTION

Figure 1:
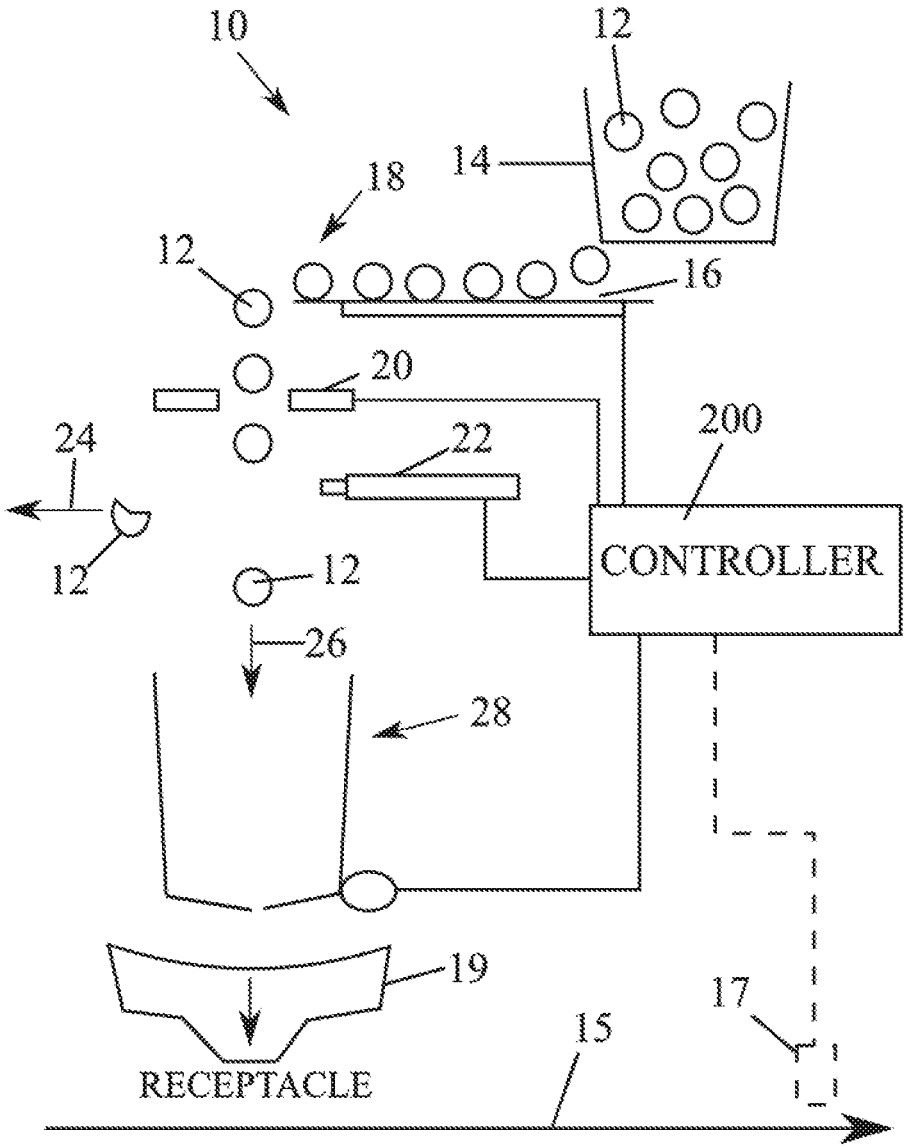
FIG. 1 is schematic side elevation of a filling machine.
Figure 2:
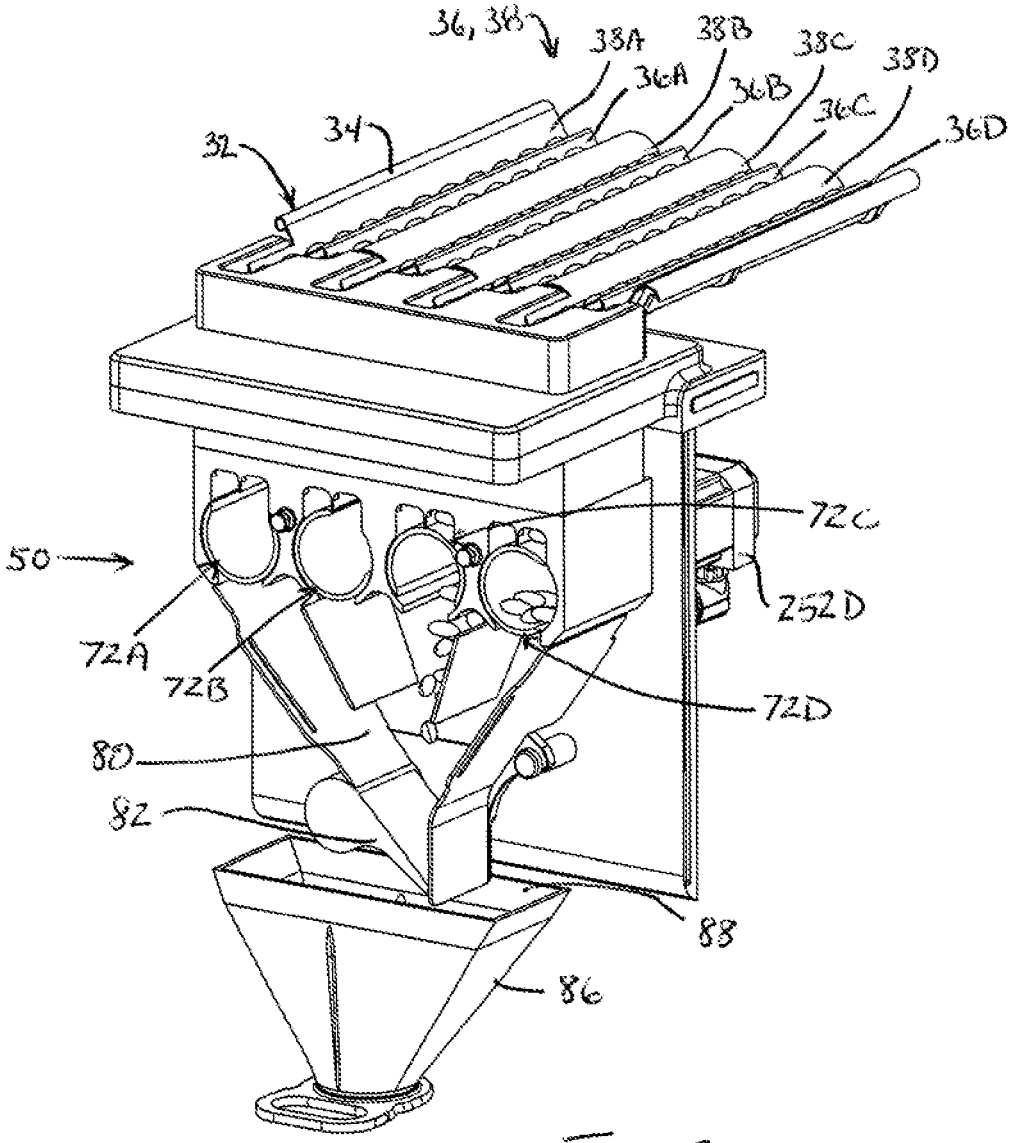
FIG. 2 is a perspective view of a portion of a filling machine including a gate assembly with multiple gate mechanisms.

FIG. 1 shows a schematic depiction of a filling device 10 for conveying, counting and analyzing items 12 and feeding the items 12 to a container, package or other receptacle. By way of example, the items may be solid dose tablets, gelcaps or capsules (e.g., of the pharmaceutical variety) and the filling device may be either intermittent or continuous type. The device 10 includes a bulk feeder 14 that deposits the items 12 to a conveyor 16, which aligns, singulates and spaces the items as they are moved to a drop point 18. The conveyor 16 may, for example, be a vibratory conveyor mechanism, as described in more detail below. As the items 12 fall along an item fall path (e.g., under gravity) they pass a sensor system 20, which counts the items as they pass so that an accurate and controlled fill count can be achieved. The sensor system 20 also analyzes the items for defects. In some cases, a reject mechanism 22 may be provided to move defective items to a reject path 24. For example, in the case of solid dose tablets, chipped tablets such as tablet 12' can be rejected. The reject mechanism could, for example, be a pressurized air unit the delivers a burst of pressurized air to move a defective item out of the item fall path and into the reject path 24. The reject mechanism could alternatively be a flap mechanism selectively movable into the item fall path to divert the item out of the item fall path by contact with the flap mechanism. In other implementations, item reject could occur further downstream in a system (e.g., by using a downstream reject mechanism 17 (e.g. blow nozzle or mechanical pusher) to move a receptacle containing a defective tablet out of the flow of a receptacle conveyance path 15 after the defective tablet is filled into the receptacle). Items 12 that are not rejected follow the fill path 26. A gate system 28 along the fill path 26 may be controlled as desired to achieve delivery of an appropriate item count to a drop chute 19 that feeds receptacles. In a typical filling device, the conveyor 16 may align the items 12 into multiple feed paths that feed the items to multiple drop points, each with a respective sensor system 20, reject mechanism 22 and gating system 28 that feed to a common drop chute 19.

Referring now to FIGS. 2-7, one embodiment of an end section 32 of a conveyor (e.g., a vibratory conveyor) is shown above a gating assembly 50. Here, the vibratory conveyor is in the form of a plate structure 34 that is bent or otherwise formed to provide a plurality of channels, each of which defines a respective feed path 36, 38 for items 12. Here, four pairs or sets of adjacent feed paths 36A and 38A, 36B and 38B, 36C and 36C and 36D and 38D are provided. At the distal end of each feed path respective item fall or drop paths 60A-60D and 62A-62D begin, with each item fall path including a respective item sensor system positioned therealong for sensing items as they fall. The gating assembly includes multiple gating systems 64A-64D, each of which is associated with a respective pair of the item fall paths (e.g., 64A associated with paths 60A and 62A). The discussion below focuses primarily on the gating system 64A, recognizing that each of the other gating systems is similarly configured.

Figure 7:
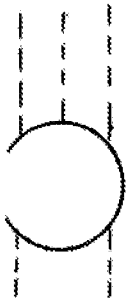
FIG. 7 shows a further possible gate mechanism position.

In this regard, each gating system (e.g., 64A), which is operable for accumulating and releasing items 12, includes two item feed paths (e.g., 60A, 62A), each of which has a respective, lower outlet end (e.g., 66A, 68A). The two paths are distinct, being separated by housing structure (such as wall 70A), but the paths run near each other and toward a single memory or count gate mechanism 72A for selectively and independently controlling both (i) whether items can exit the outlet end 66A of item path 60A and (ii) whether items can exit the outlet end 68A of item path 62A. The single gate mechanism 72A is selectively movable between multiple positions. The various positions for any given gate mechanism are reflected by the collective positions of the gate mechanisms 72A-72D shown in FIGS. 6 and 7. In particular, in the FIG. 6 gate position illustrated for gate mechanism 72D, the gate mechanism blocks both item path outlet ends 66D and 68D and, as will be explained further below, the gate mechanism is oriented to drop accumulated items to a further path 80 that is common to all of the memory or count gate mechanisms 72A-72D. In the FIG. 6 gate position illustrated for gate mechanism 72A, the gate mechanism blocks the item path outlet end 68A but does not block the item path outlet end 66A. In the FIG. 6 gate position illustrated for gate mechanism 72C, the gate mechanism blocks the item path outlet end 66C but does not block the item path outlet end 68C. In the FIG. 6 gate position illustrated for the gate mechanism 7B, the gate mechanism does not block either of the item path outlet ends 66B or 68B. FIG. 7 shows a further possible gate position in which the gate mechanism is blocking both item path outlet ends, but is not dropping accumulated items to the further path 80.

In the illustrated embodiment, each gate mechanism 72A-72D includes an arcuate wall member (e.g. 73A in FIG. 9A)) that rotates to move between the various positions. The arcuate wall members have opposed sides that define circumferentially extending gaps 74A-74D. As shown, in the FIG. 6 position of gate mechanism 72D, as well as that shown in FIG. 7, the gap 74D does not align with either of the item path outlet ends 66D, 68D, and therefore the arcuate wall blocks the path outlets. In the FIG. 6 position of gate mechanism 72A, the gap 74A aligns with item path outlet end 66A, but not with item path outlet end 68A. In the position of gate mechanism 72C, the gap 74C aligns with the item path outlet end 68C, but not with the item path outlet end 66C. In the FIG. 6 position gate mechanism 7B, the gap 74B aligns with both of the item path outlet ends 66B or 68B. Thus, each gap is large enough to simultaneously span both item paths that feed the gate mechanism.

Notably, each arcuate wall member in part defines an internal gate cavity 76A-76D. In the FIG. 6 position reflected by gate mechanism 72B the arcuate wall member is positioned below and spaced from both item path outlet ends 66B, 68B to accumulate, within cavity 76B, items exiting both item path outlet ends 66B, 68B. In the FIG. 6 position reflected by gate mechanism 72A the arcuate wall member is positioned below and spaced from item path outlet end 66A to accumulate, within cavity 76A, items exiting such outlet end 66A, while at the same time items falling along path 62A will accumulate in the lower end of the path (outside of the gate cavity 76A). In the FIG. 6 position reflected by gate mechanism 72C the arcuate wall member is positioned below and spaced from the item path outlet end 68C to accumulate, within cavity 76C, items exiting such outlet end 66C, while at the same time items falling along path 60C will accumulate in the lower end of the path (outside the gate cavity 76C). In the FIG. 6 position reflected by gate mechanism 72D, accumulation only takes place at the lower ends of the paths 60D, 62D (outside the cavity).

With respect to further path 80, such path acts as a discharge path and has an associated discharge flap or gate 82 movable between closed and open positions relative to a discharge opening 84 of the discharge path. The wall structures defining the discharge path 80 are shaped to funnel items dropped by any of the gate mechanisms 72A-72D toward the gate 82 and opening 84. A final discharge chute 86 has an upper open end 88 and may be movable relative to the discharge opening 84 (e.g., back and forth along path 90 running parallel to a path 92 of receptacle conveyance). The upper opening 88 is sized such that, at all positions of the chute 86 along the path 90, part of the opening 88 will be aligned to receive items dropped by the gate 82 through discharge opening 84. The chute 86 includes a lower outlet opening 94, which is ungated, and that can be moved in alignment with a receptacle opening (e.g., top opening in a bottle 300) as items pass from the lower outlet opening 94 and into the receptacle.

As seen in FIGS. 8A-8F, the complete gate assembly, including all paths, will typically be fully enclosed at its back side by a housing wall 132 and at its front side by a cover/housing 150 (shown here as being transparent). The cover 150 may be held in place with any suitable means (e.g., such as readily removable fasteners or key slots in the housing that are used to hang the cover on outwardly extending button posts) to allow the cover to be removed by pulling away per FIG. 8B, which then enables the gate mechanisms 72 (72A-7D) to be accessed and pulled away from respective drive seats 160A-160D per FIG. 11C. Here, the cover 150 includes spaced apart key slot openings 151, where each slot 151 aligns with and engages to a corresponding button/slot structure 153 at the end of each mount post 158.

Figures 8A, 8B, 8C:
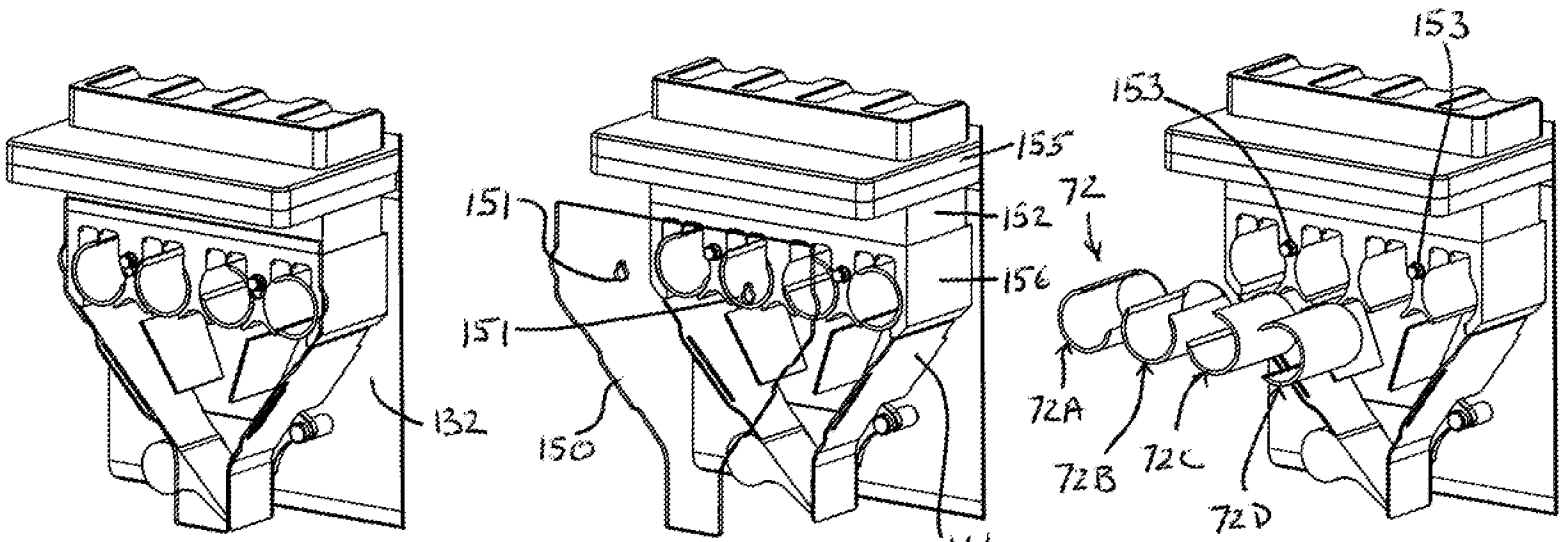
FIGS. 8A-8F depict a disassembly process for the gate assembly.
Figure 8F:
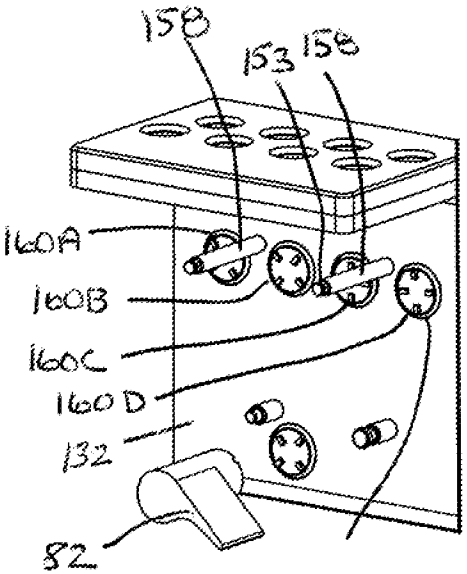
Figure 8E:
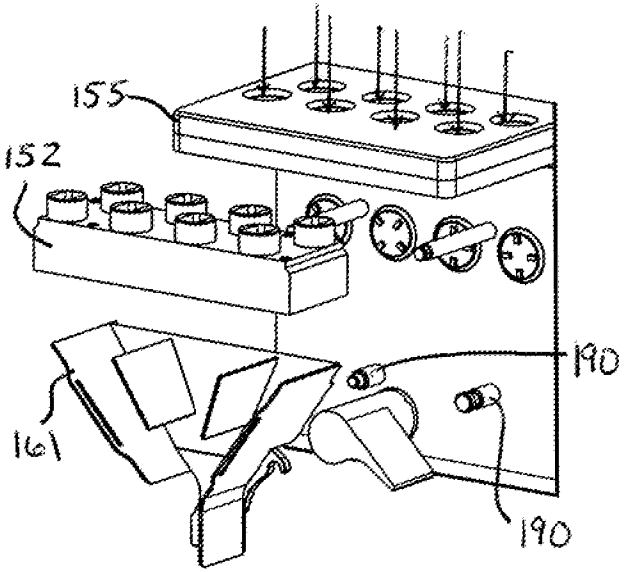
Figure 8D:
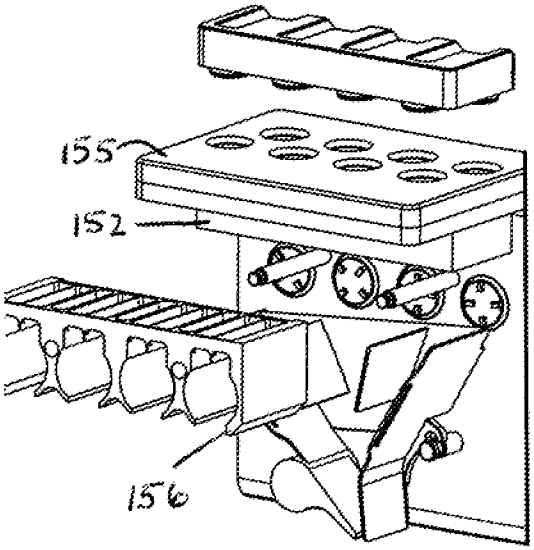

The item drop paths may be defined in part by a sensor assembly compartment 155 with passages therethrough and a housing 152 that connects to the underside of the compartment 155. The lower end of the housing is configured engage the upper end of a gate module housing 156, which in turn connects to a discharge gate housing 161. The module housing 156 includes spaced apart openings that facilitate slide-mounting onto the mount posts 158. The lower end of the housing 152 sits atop and engages with the upper end of the housing module 156 to help retain the module 156 against pulling off of the mount posts. Per FIGS. 8D and 8E, both the housing 152 and the gate housing module 156 are readily removable after the cover 150 and gate housing 161 have been removed. In this regard, the gate housing 161 may bracket structure that engages on spaced apart mount posts 190 extending from wall 132. As seen in FIG. 8F, the discharge gate 82 is also readily removable, and may be magnetically retained on a drive seat 160E. Advantageously, in the above-described implementation, each of the components 152, 156, 72, 161 and 82 can be removed without the use of tools, which facilitates quick and efficient disassembly for cleaning, and quick and efficient reassembly.

Figure 9A:
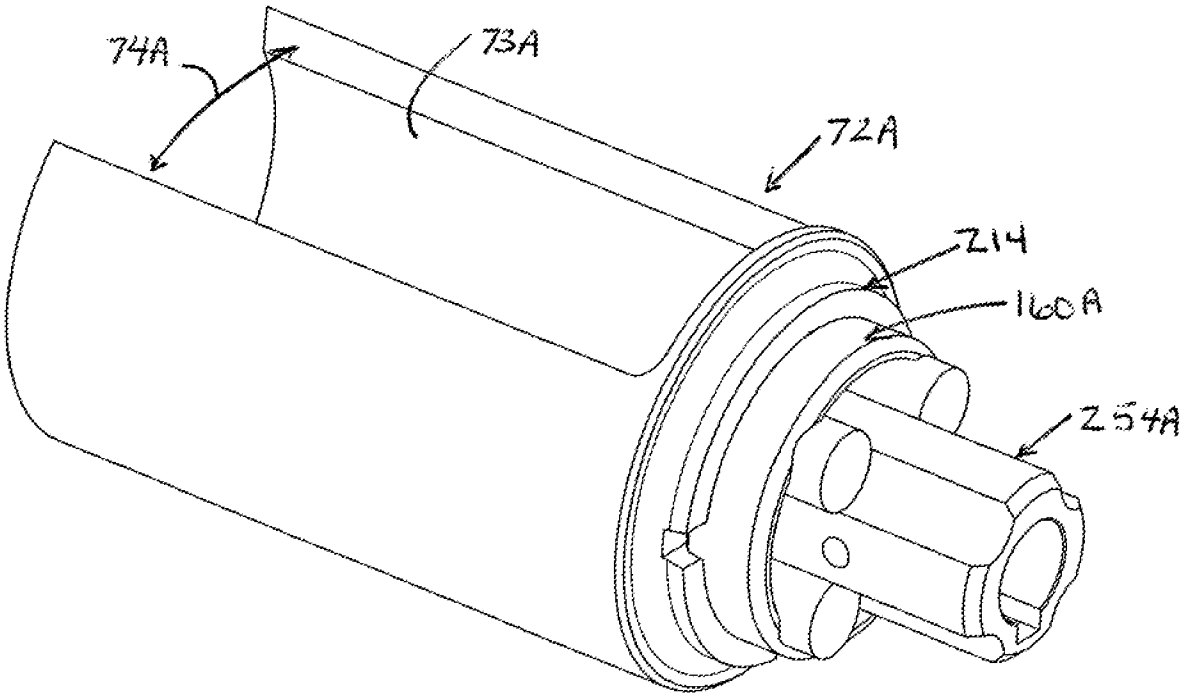
FIGS. 9A-9C show perspective views of a mating arrangement between a gating mechanism and a drive seat.
Figure 9B:
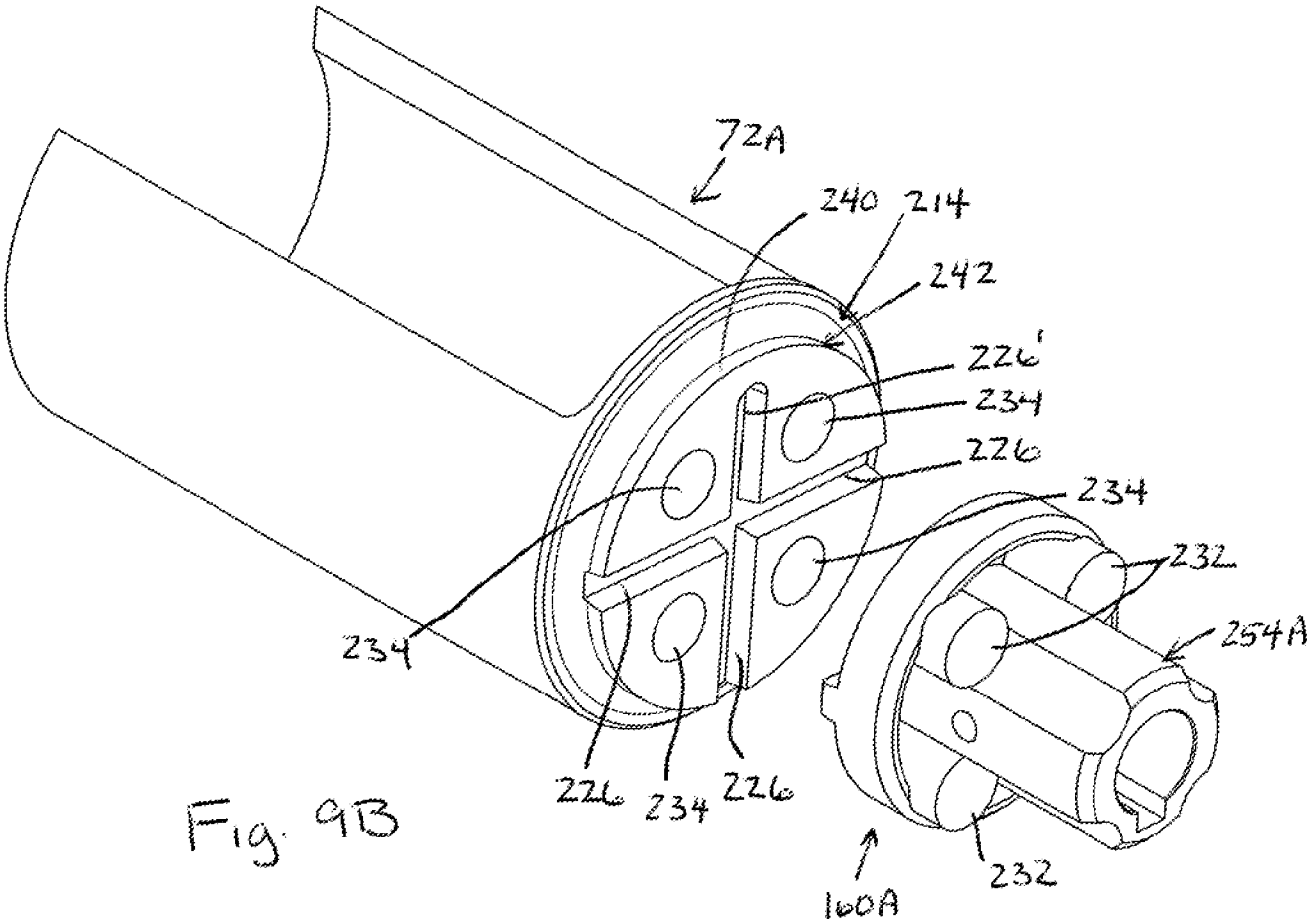
Figure 9C:
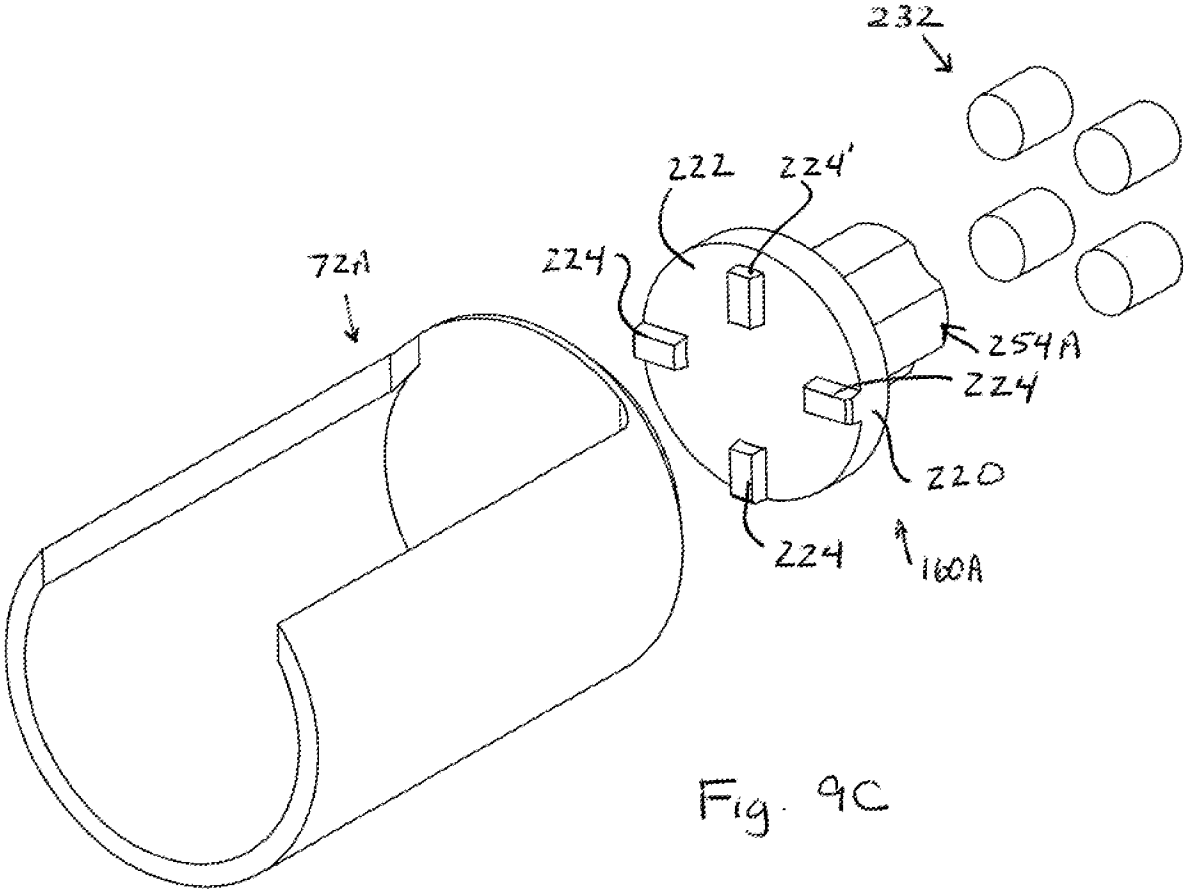

With respect to the drive seat to gate mechanism connection, reference is made to FIGS. 9A-9C. Exemplary gate mechanism 72A is shown, having a mount end 214 that engages with the drive seat 160A. Here, drive seat 160A is defined by a complete circular perimeter 220 having an end face 222 from which projecting lugs 224 extend, and the mount end 214 includes slots 226 into which the lugs fit to transmit the rotation of the drive seat 160A into rotation of the gate mechanism 72A. Here, a single one of the projection lugs 224' is inset from the perimeter 220, and a single one of the slots 226' is inset from the perimeter 240 of an end projection 242 of the mount end 214, such that only lug 224' can engage into the slot 226'. This configuration assures only a single, consistent rotational position of the gate mechanism 72A relative to the drive seat 160A is possible when the gate mechanism is mounted on the drive seat. The drive seat 160A may include multiple spaced magnets 232 that align with multiple magnetic inserts 234 on or in the mount end 214 of the gate mechanism 160A for releasbly retaining the gate mechanism on the drive seat. The arcuate wall member 73A may be of non-magnetic material, such as stainless steel or plastic, and extends from the mount end 214 that includes the inserts of magnetic material (e.g., capable of magnetic conduction and/or attraction). The inserts may, by way of example, be press-fit into openings of the mount end. Overmoulding, or other types of attachment, such as adhesives, could also be used. The gate mechanism 72A is magnetically retained on its rotatable drive seat 160A and is keyed for rotation with the rotatable drive seat or otherwise mechanically linked, either directly or indirectly to the drive seat, such that when the drive seat rotates, the arcuate wall member will likewise rotate. The gate mechanism 72A can be removed from the drive seat 150A by pulling the gate mechanism away from the drive seat with a force sufficient to overcome the magnetic attraction force.

Figure 10:
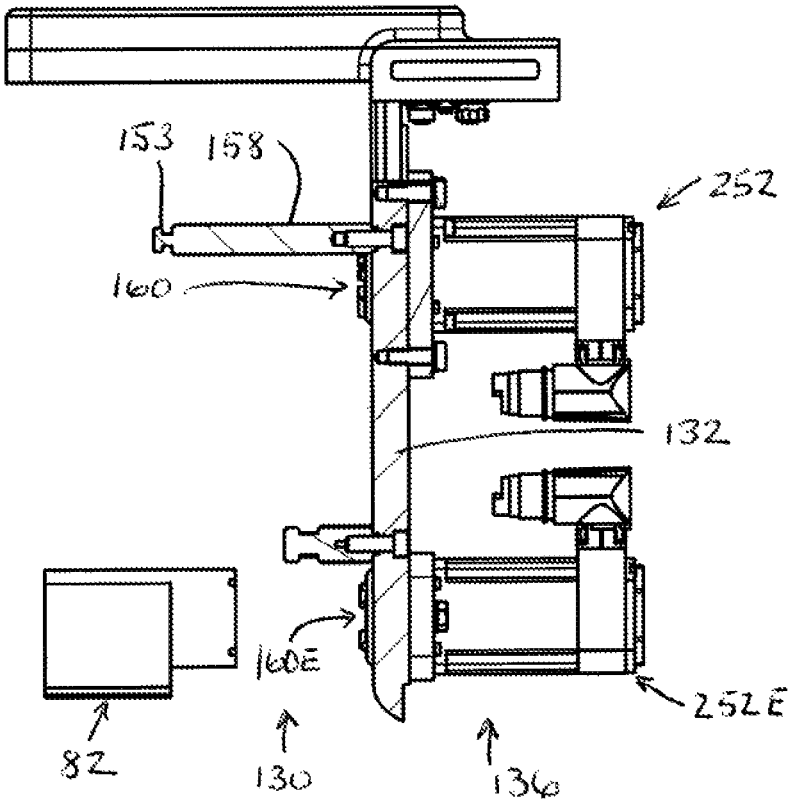
FIG. 10 shows a side elevation with gate drives on an interior side of a housing wall.

Each drive seat 160 (e.g., 160A-160D) is engaged in an opening (e.g., 250D in FIG. 8F) in the wall 132 and is driven by a respective gate drive 252 (e.g., with a drive motor, also see 252D in FIG. 2) on the interior side 136 of the wall opposite the gate mechanisms, per FIG. 10. Each rotatable drive seat extends outward from the gate side 130 of the wall 132 and is connected through the wall opening (e.g., by its drive post 254A in FIGS. 9A-9C) to be rotated by the motor of its respective gate drive. Each rotatable drive seat may be mounted in its opening with a seal arrangement that prevents particulate transfer through the opening in the wall between the opposite sides of the wall. Each rotatable drive seat may be formed by a housing that is entirely closed on the gate side of the wall 132, which facilitates cleaning when the gate mechanism is removed from the drive seat. The drive seat 160E is similarly configured, and has its own corresponding drive motor 252E on the interior side 136 of the wall 132. The drive motors for the drives may, for example, be servomotors that are also connected to be controlled by a controller 200 (FIG. 3).

The foregoing magnetic retention of the gate mechanisms to their respective drive seats provides a convenient configuration for the purpose of both assembly and disassembly of the overall gating device. All item paths and the discharge path can be easily cleaned, which can be particularly important in the pharmaceutical industry when the items being counted and delivered are pills or capsules.

The aforementioned gating assembly can be used for accurate counting and discharge of items, such as pills or capsules. In this regard, each item path may typically include a sensor for detecting items that are fed to or moving along the item path. Referring again to FIG. 3, in the case of the illustrated embodiment, and by way of example only, optical sensors may be employed for such purpose, where the structure defining or leading to each item path or track include one or more openings, or transparent or translucent sections, that allow the light to project into the item paths for the purpose of detecting passing items. Exemplary emitter and detector assemblies disposed around the drop paths are shown (e.g., sensor assembly 170D associated with drop path 60D). A controller 200 receives data signals from all of the sensors and is connected to control each of the drive motors associated with the various drive seats. The controller 200 is configured to selectively and independently cause rotation of each of the gate mechanisms 72 such that each arcuate wall member accumulates a specified count of items within its respective accumulation cavity.

Figure 3:
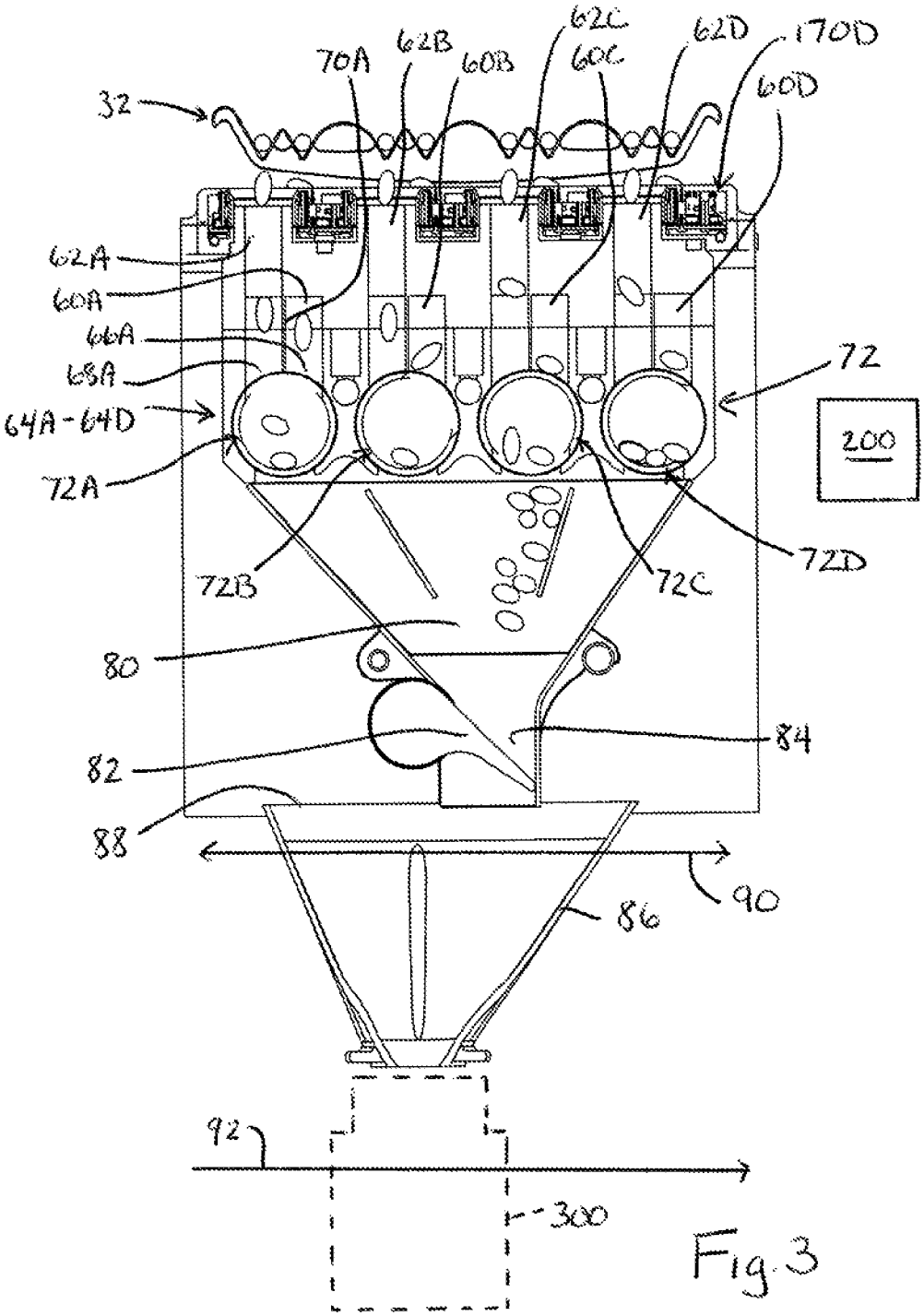
FIG. 3 is a front elevation of FIG. 2.
Figure 4:
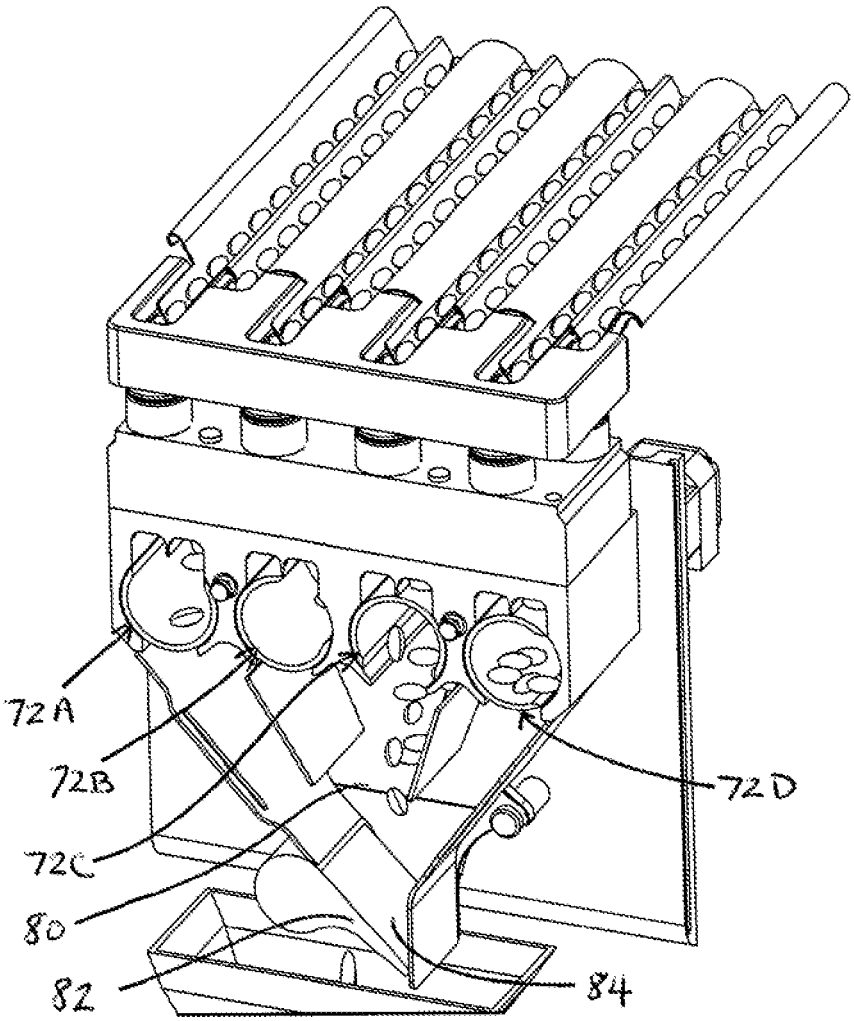
FIG. 4 is another perspective view of the upper part of the filling machine.
Figure 5:
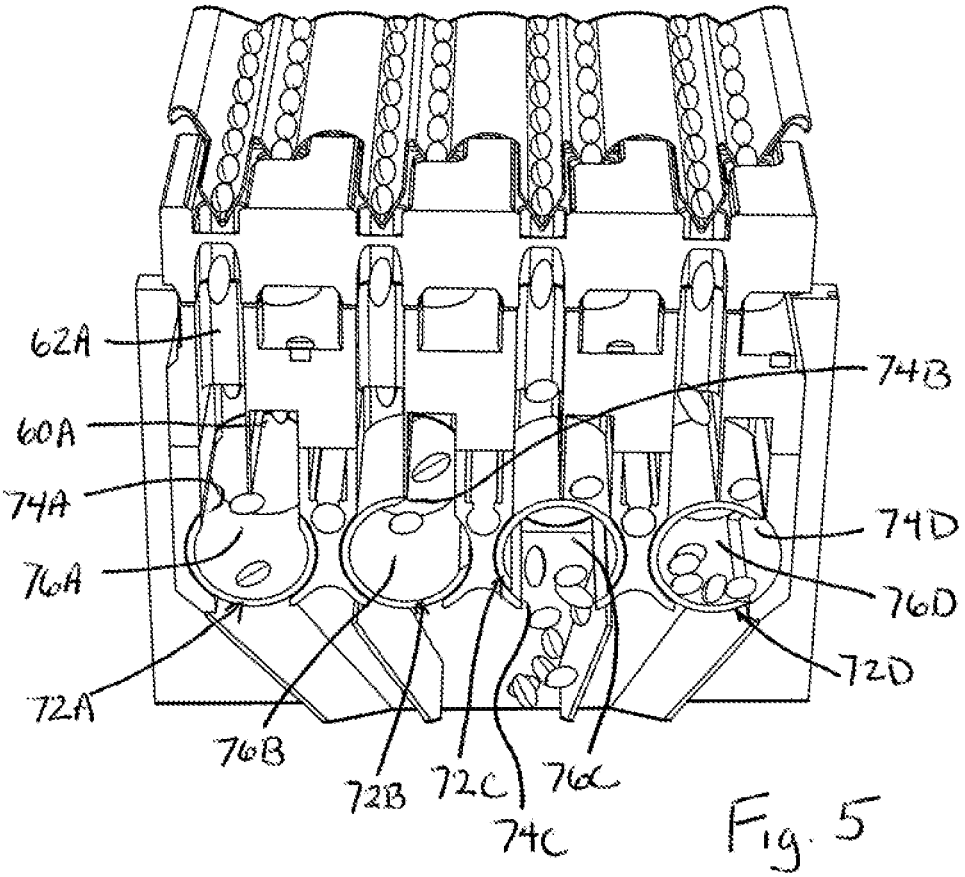
FIG. 5 is another perspective view of the upper part of the filling machine.
Figure 6:
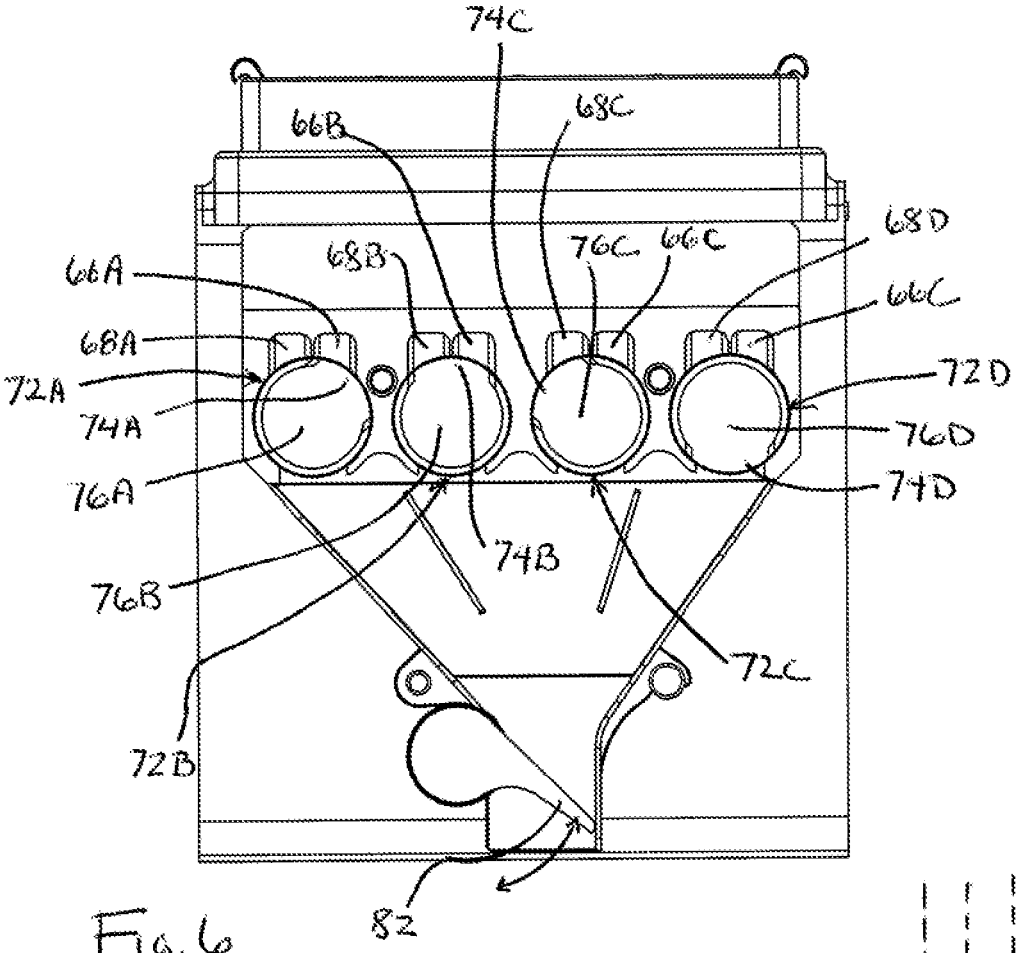
FIG. 6 is a front elevation view of the system with various gate mechanism positions depicted.

Utilizing the data from the path sensors, and with knowledge of the position of each gate mechanism, the controller 200 maintains numerous item counts in connection with operation of an assembly such as that shown in FIG. 3. In particular, the controller 200 may be configured track distinct item counts, including, as to each item path, an item path count corresponding to a total number of items that have passed along the item path but that have not exited the outlet end of the item path. In the case of the illustrated arrangement with eight item paths, this would be eight distinct item path counts. Moreover, the controller 200 may be configured to track, for each gating mechanism, a gate item count corresponding to a total number of items that have exited the outlet ends of the two item paths feeding the gate mechanism and that have accumulated in the gate collection cavity. In the case of the illustrated arrangement, this would be four distinct gate item counts. With respect to any gate item count, such count is returned to zero when the gate mechanism is rotated to its drop position to release the items to the further discharge path 80. The controller 200 may also be configured to track a discharge flap count, which corresponds to the total number of items that have been delivered from the gate mechanisms down to the discharge opening 84. Again, this discharge flap count would be returned to zero each time the flap is moved to discharge the items. Providing a gating system in which the foregoing item counts are maintained enables a dynamic ability to accumulate and discharge specific item counts in many different ways.

Generally, the controller 200 is connected to control the drive of each gate mechanism, and the controller is configured to maintain a gate item count for the gate mechanism, and to rotate the gate mechanism into a position to block both of the outlet ends of the item paths feeding the gate mechanism, when the gate item count reaches a predefined target count (e.g., between two and twenty items, or any other number). In a most straight forward system, the predefined target count for each gate mechanism is the same, and the predefined target count matches the desired number items to be delivered to each receptacle. In such an implementation, each gate mechanism achieves its gate count, is moved to block its item feed paths, and then awaits its turn to rotate into the drop position (e.g., the position of gate mechanism 72C in FIG. 3) that will feed the items to the discharge flap 82 and opening 84. Once the discharge flap is moved to its open position to deliver the items to the chute 86 and has closed again, a next one of the gate mechanisms that has reached the predefined target count can be rotated to the drop position.

In a more complex system, the items dropped by multiple gate mechanisms could be accumulated at the discharge flap 82 and opening 84. For example, if the target delivery count for each receptacle is twenty items, and the predefined target count for accumulation in each gate cavity is ten items, then the controller could control the system so that two gate mechanisms must have previously moved to respective drop positions (i.e., to drop twenty items total) before the discharge flap 82 is moved to its open position.

In terms of achieving the predefined target count in each gate cavity, the controller 200 may be configured to predictively ready the gate mechanism for blocking of both item paths. For example, and referring again to FIG. 3, the controller 200 may be configured to rotate the mechanism into a "receive from both item paths" position (i.e., the position illustrated for gate mechanism 72A) to begin to accumulate items in the gate collection cavity. Notably, upon such movement any items previously accumulated at the lower ends of the item paths, and counted in the item path counts, will drop into the gate cavity and the controller will automatically add the item path counts to the zeroed out gate item count. The controller 200 maintains a running count if items accumulated in the gate cavity (the gate item count), and the controller rotates the gate mechanism into a "block one item path" position (i.e., the position illustrated for gate mechanism 72B) when the running count/gate item count approaches the predefined target count (e.g., if the predefined target count is ten, the running count reaching eight could be the trigger for movement to the block one item path position). The controller 200 continues to maintain the running count and rotates the gate mechanism into a "block both item paths" position (i.e., the position illustrated for gate mechanism 72D) when the running count/gate item count reaches the predefined target count.

In one implementation, the controller 200 is also configured to handle double item count situations (i.e., situations in which two items are falling through the detection region of the sensor assembly of an item drop path at least partly simultaneously). In these situations, a robust sensor assembly (e.g., 170D) can identify and increment the item count by two instead of one. Moreover, in a case where the running count/gate item count for a gate is already only one less than the defined target count (e.g., target count=20 and running count=19), and the sensor assembly for a first drop path to the gate identifies a double count (two items falling simultaneously), the controller is configured to immediately rotate the gate to a position to block the two items from entering the gate cavity. The controller then permits the second drop path that feeds the gate cavity to be used to complete the gate count so that the quantity accumulated in the gate cavity will match the defined target count exactly (rather than being one greater than the target count).

In some situations, if the sensor assembly of both drop paths to a gate cavity identify a double count when the running count/gate item count for a gate is already only one less than the defined target count, then the controller may be configured accept an overcount in the gate cavity (e.g., control the gate to permit 21 instead of 20 in the gate cavity). Alternatively, the controller may be configured to accept an undercount (e.g., 19 instead of 21), in which the controller is configured make up for the undercount by contributing a single item from another gate cavity, if and when another gate cavity is able to do so, so that the total number of items collectively delivered to the discharge gate will be the desired number (e.g., 20).

In some cases, the controller may be configured so that multiple gate collection cavities are used to achieve a desired fill count for a container. In such cases, a running count for each gate collection cavity is maintained and a sum of these counts (the summed running count) is compared to a defined target count that corresponds to the desired container fill count. When the summed running count reaches the defined target count, the gates are controlled so that all drop paths are closed and the items from all collection cavities are dropped to the discharge gate. In such cases, the controller 200 is configured so that if the sensor assembly of a drop path identifies a double count when the summed running count is already only one less than the defined target count (e.g., target count=20 and running count=19), then the controller will close the drop path associated with the double count and allow one of the other gate cavities to collect the one additional item needed.

In certain implementations, the controller 200 is also configured to handle exceedingly close items in a drop path in the same manner as double count items. Exceedingly close items would be two items that are not passing through the detection region of the sensor assembly simultaneously, but are passing one immediately behind another in such a close manner that an overcount could result if the running count/gate item count for a gate is already only one less than the defined target count.

Other logic features of the controller 200 enable specific control of the item conveyor 32 as needed to avoid undesired count accumulation. For example, if the item path counts for the two paths of a given gate mechanism reach the predefined target count for the gat cavity while the gate mechanism is in position to block the item paths, any further progression of items from the conveyor into those item paths would create an issue of a potential excess feed. Accordingly, in such a situation the controller 200 may be configured to temporarily stop the conveyor from feeding additional items.

Figure 11:
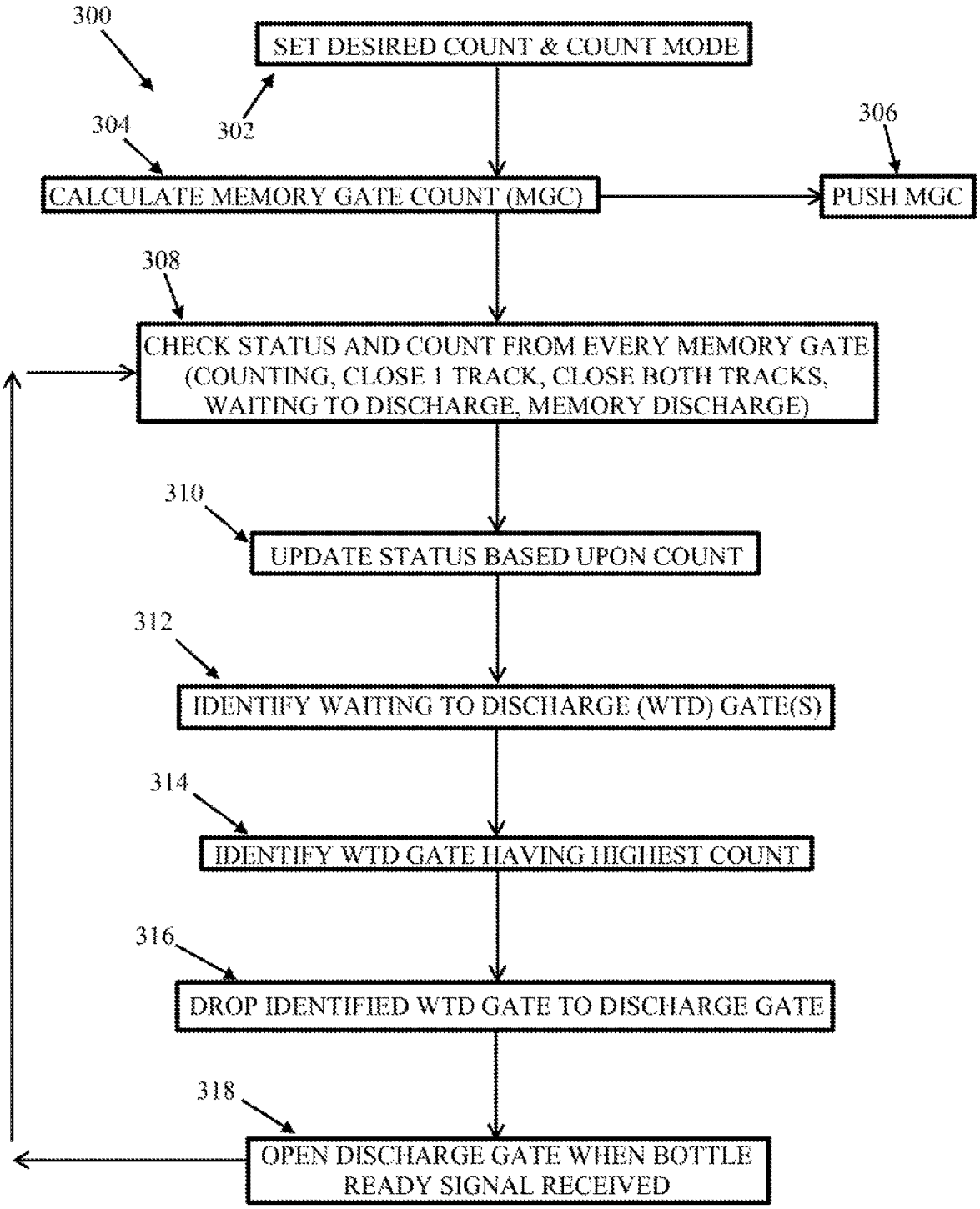
FIG. 11 is an exemplary algorithm for the control process gate assembly.

Referring now to FIG. 11, a high level algorithm 300 reflective of exemplary operation of a system including multiple gate mechanisms is shown. At step 302 a desired count and a counting mode are set. By way of example, one count mode could be a mode in which a cumulative count in all of the gating mechanism cavities is totaled and tracked and when the total of all gates reaches the desired count, all four gates are simultaneously rotated to drop positions. Another count mode could be a mode in which the desired count is accumulated in each track above the gate in each item path or track, and may typically be used for smaller counts, such as one to ten tablets. Another count mode could be a mode in which the desired count is accumulated within each gate cavity, and may typically be used for larger counts, such as ten to 100 tablets. Another count mode could be a mode in which a very large desired count (e.g., greater than 100 tablets) is achieved by repeatedly filling each gate and dropping each gate, while container/bottle movement remains stopped below the discharge gate, until the desired count is reached.

At step 304, a count for each gate mechanism is calculated based upon the desired count and mode, and the resulting memory gate count parameter is pushed to the gate count algorithm per step 306. At step 308 the status and count of each gate is checked. Exemplary status possibilities include Counting, Closing 1 Track, Closing Both Tracks, Waiting to Discharge and Memory Discharge). Counting simply represents that the particular gate has not yet approached its MGC. Closing 1 Track indicates that a gate has almost reached its MGC. Closing Both Tracks means that a gate has reached its MGC. Waiting to Discharge means that a gate has achieved its MGC and is awaiting selection for rotation to discharge or drop to the discharge gate. Memory Discharge means that the gate is in the process of discharging or dropping to the discharge gate.

At step 310, gate status for the gates is updated based upon changes in counts. At step 312, all gates that are waiting to discharge are identified. At step 314, from among the gates identified in step 312, the gate that has the highest count is identified. At step 316 the gate identified in step 314 is rotated to the drop position to drop to the discharge gate. At step 318 the discharge gate is opened when a bottle ready signal is received (e.g., a signal provided by a bottle detection sensor). Steps 308 through 318 are repeated as necessary to continue filling multiple containers/bottles.

Figure 12:
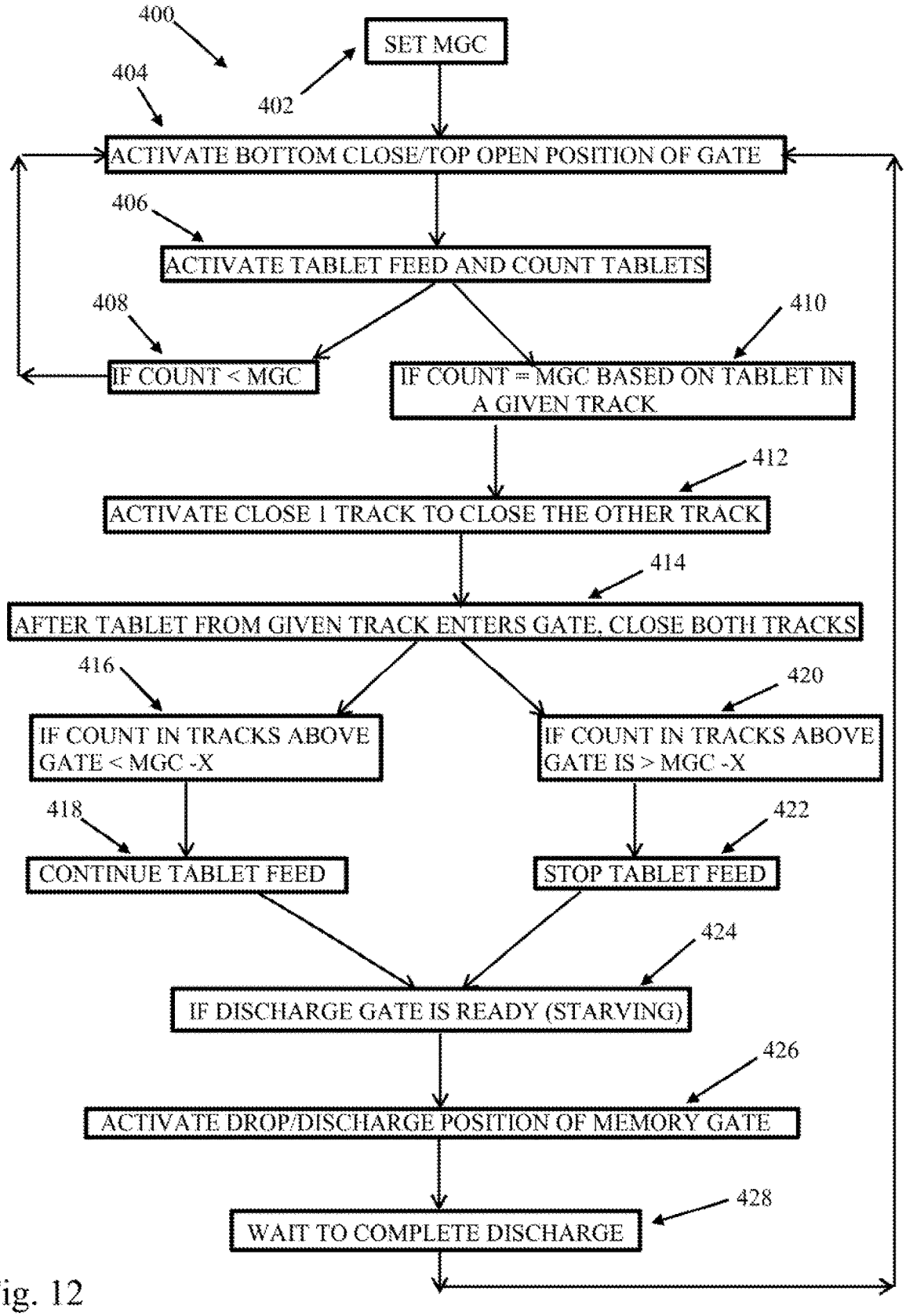
FIG. 12 is an exemplary algorithm for the control process of a single gate of the gate assembly.
Figure 13A:
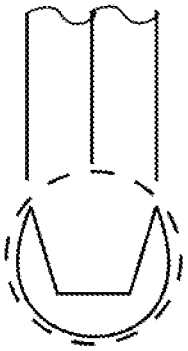
FIGS. 13A-13E are schematic depictions of alternative gate wall configurations.
Figure 13B:
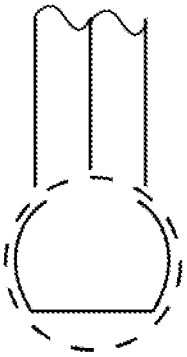
Figure 13C:
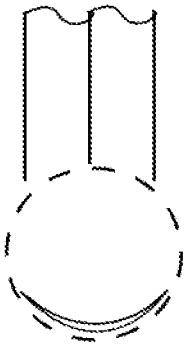
Figure 13D:
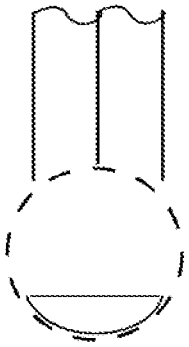
Figure 13E:
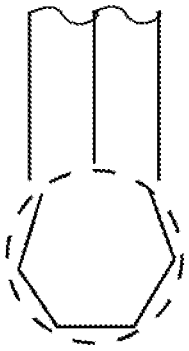

FIG. 12 shows an exemplary algorithm 400 for individual gate control and counting to achieve a count within the gate cavity and then drop that count from the memory gate to the discharge gate. At step 402 the count to be achieved is set, per the MGC pushed from the overall gating algorithm, and step 404 the gate is moved to the position so that both paths to the gate cavity are open and the bottom of the memory gate is closed (e.g., per the position of gate 72A in FIG. 3). At step 406 the tablet feed is activated and tablet counting begins. As long as the actual count of tablets dropped along both item feed paths to the gate is less than the MGC, per decision step 408, the feed and count process continues without movement of the memory gate. However, once the actual count of tablets dropped along both item feed paths to the gate reaches the MGC per 410, then the memory gate is moved to the close one path position per step 412. More specifically, if the counted tablet that reaches the MGC is in the left track, then the gate will be moved to close the right track (e.g., per the position of gate 72C in FIG. 6). On the other hand, if the counted tablet that reaches the MGC is in the right track, then the gate will be moved to close the left track (e.g., per the position of gate 72A in FIG. 6). At step 414, after the counted tablet that reaches the MGC actually makes its way into the gate cavity, the gate is moved to the close both tracks position (e.g., the position of gate 72D in FIG. 3). At this point, the memory gate is waiting for its opportunity to drop to the discharge gate, but tablet feed will or may continue for at least some part of the wait time. During this time the controller will maintain a total count of tablets that are accumulating above the gate in the tracks. Per steps 416 and 418, as long as the count above the gate is not too close to the MGC for the gate (e.g., the count is less than MGC−X), then tablet feed and counting continues. However, per steps 420 and 422, if the count above the gate approaches the MGC (e.g., the count is greater than MGC−X) the tablet feed will be stopped in order to prevent the total number of tablets that accumulate above the gate from exceeding the MGC. If the discharge gate is ready to receive a drop per step 424, and if the gate is selected as the next gate to drop (per steps 314 and 316 of algorithm 300), then the gate is rotated to the drop position for a sufficient time to drop its count, per steps 426 and 428.

The foregoing operational sequence can be carried out by any suitable control arrangement of the filling machine. As used herein the term "controller" is intended to encompass any circuit (e.g., solid state, application specific integrated circuit (ASIC), an electronic circuit, a combinational logic circuit, a field programmable gate array (FPGA)), processor(s) or microprocessor(s) (e.g., shared, dedicated, or group—including hardware or software that executes code), software, firmware and/or other components, or a combination of some or all of the above, that carries out the control functions.

It is to be clearly understood that the above description is intended by way of illustration and example only, is not intended to be taken by way of limitation, and that other changes and modifications are possible.

For example, while the gate mechanism described above are formed primarily by wall members that are completely arcuate, it is recognized that variations are possible, such as those depicted in FIGS. 13A-13E, including variations where the wall members defining each gate mechanism may include some segments or portions, or all segments or portions, that are non-arcuate. In such instances the wall member segments are still arranged in a partially surrounding path to define the gate cavity.

Other variations and modifications are possible.

What is claimed is:

1. A filling machine for filling a receptacle with a plurality of items, the filling machine comprising:

a first item drop path having an outlet end;

a second item drop path having an outlet end, the second item drop path distinct from the first item drop path;

a gating system for selectively accumulating and releasing items, the gating system including:

a single gate mechanism configured for selectively and independently controlling both (i) whether items can exit the outlet end of the first item drop path and (ii) whether items can exit the outlet end of the second item drop path.

2. The filling machine of claim 1, wherein the gating system is a first gating system, the filling machine further comprising:

a third item drop path having an outlet end;

a fourth item drop path having an outlet end, the fourth item drop path distinct from the third item drop path;

a second gating system for selectively accumulating and releasing items, the second gating system including:

a second single gate mechanism configured for selectively and independently controlling both (i) whether items can exit the outlet end of the third item drop path and (ii) whether items can exit the outlet end of the fourth item drop path;

wherein the first gating system and the second gating system both feed a common discharge path having an associated discharge gate movable between closed and open positions relative to a discharge opening of the discharge path.

3. The gating system of claim 1, wherein:

a controller is configured to maintain a running count of items collected in a gate collection area of the single gate mechanism;

in a case where (i) the running count of items collected in the gate collection area is only one less than a defined target count and (ii) a sensor assembly associated with the first item drop path to the gate collection area indicates at least one of a count of two simultaneous falling items or a count of two exceedingly close falling items, the controller is configured to move the single gate mechanism to a position to block the first item drop path so as to prevent the two simultaneous falling items or the two exceedingly close falling items from entering the gate collection area in order to prevent the number of items collected in the gate collection area from exceeding the defined target count.

4. The filling machine of claim 1, wherein:

the single gate mechanism comprises a wall member that is configured to partially surround and define a gate cavity;

the wall member has opposed sides that define a gap into the gate cavity;

a gate drive is connected for rotating the wall member, wherein the wall member is removably mounted to a rotatable drive seat of the gate drive for rotation by the rotatable drive seat, wherein the wall member is magnetically retained on the rotatable drive so as to rotate with the rotatable drive seat.

5. The filling machine of claim 4, wherein:

the rotatable drive seat extends outward from a first side of a wall and is connected, through an opening in the wall, to be rotated by a motor of the gate drive, the motor located on a second side of the wall;

the rotatable drive seat is mounted in the opening with a seal arrangement that prevents particulate transfer through the opening in the wall between the first side of the wall and the second side of the wall, wherein the rotatable drive seat is formed by a housing that is entirely closed on the first side of the wall.

6. The filling machine of claim 1, wherein:

the single gate mechanism comprises a wall member that is configured to partially surround and define a gate cavity;

the wall member has opposed sides that define a gap into the gate cavity;

the wall member is rotatable into multiple positions, including:

a first position in which items exiting the outlet end of the first item drop path and the outlet end of the second item drop path enter and accumulate in the gate cavity;

a second position in which (i) items moving along the first item drop path are blocked by the wall member and accumulate in a lower region of the first item drop path and (ii) items moving along the second item drop path enter and accumulate in the gate cavity; and a third position in which (i) items moving along the first item drop path are blocked by the wall member and accumulate in the lower region of the first item drop path and (ii) items moving along the second item drop path are blocked by the wall member and accumulate in a lower region of the second item drop path.

7. The filling machine of claim 6, wherein:

in the third position, items accumulated within the gate cavity are retained in the gate cavity;

wherein the wall member is rotatable into a fourth position in which (i) items accumulated within the gate cavity are dropped out of the gate cavity to a further discharge path, (ii) items moving along the first item drop path are blocked by the wall member and accumulate in the lower region of the first item drop path and (iii) items moving along the second item drop path are blocked by the wall member and accumulate in the lower region of the second item drop path.

8. The filling machine of claim 7, wherein the wall member is arcuate in shape.

9. The filling machine of claim 1, wherein the single gate mechanism is selectively movable between at least a first position, a second position and a third position.

10. The filling machine of claim 9, wherein the single gate mechanism comprises a wall member that is configured to partially surround and define a gate cavity, wherein the wall member is rotatable to move between the first, second and third positions, wherein the wall member has opposed sides that define a gap into the gate cavity, wherein when the single gate mechanism is in the first position the gap aligns with both the outlet end of the first item drop path and the outlet end of the second item drop path, and the gate cavity is positioned below both the outlet end of the first item drop path and the outlet end of the second item drop path so as to stop and accumulate both items exiting the outlet end of the first item drop path and items exiting the outlet end of the second item drop path;

when the single gate mechanism is in the second position the gap does not align with the outlet end of the first item drop path but does align with the outlet end of the second item drop path, and the gate cavity is positioned below the outlet end of the second item drop path to stop and accumulate items exiting the outlet end of the second item drop path;

when the single gate mechanism is in the third position the gap does not align with the outlet end of the second item drop path and does not align with the outlet end of the first item drop path, such that items cannot enter the gate cavity from either the first item drop path or the second item drop path.

11. The filling machine of claim 10, further comprising:

at least a first sensor for detecting items that are fed to or moving along the first item drop path;

at least a second sensor for detecting items that are fed to or moving along the second item drop path;

a controller for receiving data from the first sensor and the second sensor, the controller configured to control rotation of the wall member, wherein the controller is configured to selectively rotate the wall member so as to accumulate a specified count of items within the gate cavity.

12. The filling machine of claim 11, wherein the specified count of items is a specified count to be delivered to a receptacle moving along a conveyance path below the gating system.

13. The filling machine of claim 12, further comprising:

a discharge path having an associated discharge gate movable between closed and open positions relative to a discharge opening of the discharge path, wherein the gating system feeds items to the discharge path, and the controller is configured to control movement of the discharge gate to feed items to the receptacle moving along the conveyance below the discharge opening of the discharge path.

14. The filling machine of claim 13, further comprising a final discharge chute having an upper open end movable relative to the discharge opening and a lower outlet opening that is moved in alignment with the receptacle as items pass from the lower outlet opening and into the receptacle.

15. The filling machine of claim 9, wherein:

when the single gate mechanism is in the first position, the single gate mechanism blocks both the outlet end of the first item drop path and the outlet end of the second item drop path, when the single gate mechanism is in the second position, the single gate mechanism blocks the outlet end of the first item drop path but does not block the outlet end of the second item drop path, wherein, when the single gate mechanism is in the third position, the single gate mechanism does not block the outlet end of the first item drop path and does not block the outlet end of the second item drop path.

16. The filling machine of claim 15, wherein the single gate mechanism is selectively movable to a fourth position, when the single gate mechanism is in the fourth position, the single gate mechanism blocks the outlet end of the second item drop path but does not block the outlet end of the first item drop path.

17. The filling machine of claim 16, wherein the single gate mechanism comprises a wall member that is configured to partially surround and define a gate cavity, wherein the wall member is rotatable to move between the first, second, third and fourth positions.

18. The filling machine of claim 17 wherein the wall member is movable to a drop position, when the wall member is in the drop position, the wall member is rotated so that the gap drops items from the gate cavity to a further path and the wall member blocks both the outlet end of the first item drop path and the outlet end of the second item drop path.

19. The filling machine of claim 17, wherein the wall member has opposed sides that define a gap into the gate cavity, wherein:

when the single gate mechanism is in the first position, the gap does not align with the outlet end of the first item drop path or the outlet end of the second item drop path, when the single gate mechanism is in the second position, the gap does not align with the outlet end of the first item drop path but does align with the outlet end of the second item drop path, when the single gate mechanism is in the third position, the gap aligns with both the outlet end of the first item drop path and the outlet end of the second item drop path.

20. The filling machine of claim 19, wherein when the single gate mechanism is in the second position, the gate cavity is positioned below the outlet end of the second item drop path to stop and accumulate items exiting the outlet end of the second item drop path, when the single gate mechanism is in the third position, the gate cavity is positioned below both the outlet end of the first item drop path and the outlet end of the second item drop path so as to stop and accumulate both items exiting the outlet end of the first item drop path and items exiting the outlet end of the second item drop path.

21. A gating system for accumulating and releasing items, comprising:

a first item drop path having an outlet end;

a second item drop path having an outlet end, the second item drop path distinct from the first item drop path;

a first gate mechanism with a single gate wall configured and movable for selectively and independently controlling both (i) whether items can exit the outlet end of the first item drop path and (ii) whether items can exit the outlet end of the second item drop path.

22. The gating system of claim 21, further comprising:

a third item drop path having an outlet end, the third item drop path distinct from the first and second item drop paths;

a fourth item drop path having an outlet end, the fourth item drop path distinct from the first, second and third item drop paths;

a second gate mechanism with a single gate wall configured and movable for selectively controlling both (i) whether items can exit the outlet end of the third item drop path and (ii) whether items can exit the outlet end of the fourth item drop path.

23. The gating system of claim 22, wherein:

the single gate wall of the first gate mechanism comprises a first rotatable wall that is configured to partially surround and define a first gate cavity, the first rotatable wall has opposed sides defining a first wall gap into the first gate cavity, wherein, when the first wall gap is aligned with both the outlet end of the first item drop path and the outlet end of the second item drop path, the first gate cavity is positioned below both the outlet end of the first item drop path and the outlet end of the second item drop path to stop and accumulate in the first gate cavity items exiting both the outlet end of the first item drop path and the outlet end of the second item drop path;

the single gate wall of the second gate mechanism comprises a second rotatable wall that is configured to partially surround and define a second gate cavity, the second rotatable wall has opposed sides defining a second wall gap, when the second wall gap is aligned with both the outlet end of the third item drop path and the outlet end of the fourth item drop path, the second gate cavity is positioned below both the outlet end of the third item drop path and the outlet end of the fourth item drop path to stop and accumulate in the second gate cavity items exiting both the outlet end of the third item drop path and the outlet end of the fourth item drop path.

24. The gating system of claim 21, further comprising:

at least a first sensor for detecting items that are fed to or moving along the first item drop path;

at least a second sensor for detecting items that are fed to or moving along the second item drop path;

wherein the single gate wall of the first gate mechanism comprises a first rotatable wall and has opposed sides defining a first wall gap, wherein, when the first wall gap is aligned with both the outlet end of the first item drop path and the outlet end of the second item drop path, the first rotatable wall is positioned below both the outlet end of the first item drop path and the outlet end of the second item drop path to define a gate collection cavity that accumulates items exiting both the outlet end of the first item drop path and the outlet end of the second item drop path;

wherein the controller is configured to track distinct item counts, including:

a first item count corresponding to a total number of items that have passed along the first item drop path but that have not exited the outlet end of the first item drop path, a second item count corresponding to a total number of items that have passed along the second item drop path but that have not exited the outlet end of the second item drop path, a gate item count corresponding to a total number of items that have exited the outlet end of the first item drop path and the outlet end of the second item drop path and that have accumulated in the gate collection cavity.

25. The gating system of claim 24, further comprising:

a drive for rotating the first rotatable wall, wherein the controller is connected and configured to control the drive so as to rotate the first rotatable wall into a position to block both the outlet end of the first item drop path and the outlet end of the second item drop path when the gate item count reaches a predefined count.

26. A gating system for accumulating and releasing items, comprising:

a first item path having an outlet end;

a second item path having an outlet end, the second item path adjacent to and distinct from the first item path;

a single gate mechanism having an arcuate wall member that defines a gap, wherein the arcuate wall member is mounted for rotation; and a gate drive for selectively and independently rotating the single gate mechanism to control both (i) whether items can exit the outlet end of the first item path via the gap and (ii) whether items can exit the outlet end of the second item path via the gap.

27. The gating system of claim 26, wherein the gap has a circumferential extent that is sufficient to simultaneously span both the outlet end of the first item path and the outlet end of the second item path.

28. The gating system of claim 27, wherein the arcuate wall member is removably mounted to a rotatable drive seat of the gate drive for rotation by the rotatable drive seat, wherein the arcuate wall member is magnetically retained on the rotatable drive seat and is configured for rotation with the rotatable drive seat.

* * * * *